US005665513A

United States Patent [19]

Ida et al.

[11] Patent Number: 5,665,513

[45] Date of Patent: Sep. 9, 1997

[54] TONER FOR DEVELOPING ELECTROSTATIC CHARGED IMAGE

[75] Inventors: Tetsuya Ida; Masaaki Taya; Tsuyoshi Takiguchi, all of Kawasaki, Japan

[73] Assignee: Canon Kabushiki Kaisha, Tokyo, Japan

[21] Appl. No.: 705,522

[22] Filed: Aug. 29, 1996

[30] Foreign Application Priority Data

Aug. 30, 1995 [JP] Japan ..... 7-243888

[51] Int. Cl.[6] ..... G03G 9/097

[52] U.S. Cl. ..... 430/110

[58] Field of Search ..... 430/106, 108, 430/109, 110

[56] References Cited

U.S. PATENT DOCUMENTS

| | | | |
|---|---|---|---|
| 2,297,691 | 10/1942 | Carlson | 95/5 |
| 4,845,003 | 7/1989 | Kiriu et al. | 430/110 |
| 5,223,368 | 6/1993 | Ciccarelli et al. | 430/110 |
| 5,324,613 | 6/1994 | Ciccarelli et al. | 430/110 |

FOREIGN PATENT DOCUMENTS

| | | |
|---|---|---|
| 42-23910 | 11/1967 | Japan . |
| 42-24748 | 10/1968 | Japan . |
| 45-26478 | 9/1970 | Japan . |
| 55-42452 | 10/1980 | Japan . |
| 63-208865 | 8/1988 | Japan . |
| 63-237065 | 10/1988 | Japan . |
| 5-197207 | 8/1993 | Japan . |

*Primary Examiner*—John Goodrow

*Attorney, Agent, or Firm*—Fitzpatrick, Cella, Harper & Scinto

[57] ABSTRACT

The present invention provides a toner, particularly color toner, for developing an electrostatic image, which comprises toner particles containing a mixture of a binder resin, a coloring agend and compounds (I) and (II).

16 Claims, No Drawings

TONER FOR DEVELOPING ELECTROSTATIC CHARGED IMAGE

BACKGROUND OF THE INVENTION

1. Field of the Invention

The present invention relates to a toner for developing an electrostatic charged image in an image forming method such as the electrophotography method or the electrostatic recording method.

2. Related Background Art

As electrophotography methods, various methods have conventionally been proposed in, for example, the U.S. Pat. No. 2,297,691, Japanese Patent Publication No. 42-23910 and Japanese Patent Publication No. 43-24748.

The electrophotography methods are broadly classified into the dry development method and the wet development method. The former further divided into a method using a two-component developing agent and a method using a one-component developing agent.

As a toner applied in these dry development methods, a fine powder prepared by dispersing a dyestuff or a pigment in a binder resin is used. For example, particles prepared by finely dividing a mixture formed by dispersing a coloring agent in a binder resin such as polystyrene to a size of from about 1 to 30 μm are used as toner particles. A toner containing magnetic particles such as magnetite is employed as a magnetic toner. In the case of a two-component developing agent, a toner is usually used in mixture with such carrier particles as iron powder or magnetic ferrite particles.

Along with the recent tendency toward more personal uses, a higher speed, and more diversified functions, there is an increasing demand for a toner which is excellent in environmental stability and durability, gives a high image density, is free from fogging, is rich in resolution, and is capable of forming an image clear in contrast and excellent in gradation. More recently, furthermore, such new manners of development as reversal development, digital development and low-potential development are being used in addition to positive development and analog development, and a toner capable of forming a high-quality toner image in any of these development practices is demanded.

In order for a toner to satisfactorily cope with any of these development methods, it is important that triboelectric characteristics of the toner is sufficiently controlled.

When causing a toner to retain a charge, while it is possible to utilize triboelectric characteristics of a binder resin, a binder resin has generally only a low triboelectric property. An image formed with such a toner is susceptible to fogging and is not clear. For this reason, it is the common practice to add a dyestuff or a pigment for controlling triboelectric property, or even a charge controlling agent to impart a desired triboelectric property to a toner.

Charge controlling agents known at present in the referred technical area include, as positive triboelectric materials, Nigrosine dyestuff, azine based dyestuff, copper phthalocyanine based pigment, quarternary ammonium salt, and polymers having quarternary ammonium salt in a side chain, and as negative triboelectric materials, metal complexes of monoazo dyestuff, metal complex salts of salicylic acid, alkylsalicylic acid, dialkylsalicylic acid, naphthoic acid, dicarboxlic acid, and resins having acid groups. These charge controlling agents are proposed in Japanese Patent Publication No. 41-20153, Japanese Patent Publication No. 43-17955, Japanese Patent Publication No. 45-26478, and Japanese Patent Publication No. 55-42452.

A toner containing a compound having an Al salt structure is proposed in Japanese Patent Application Laid-Open No. 63-237065 and Japanese Patent Application Laid-Open No. 5-197207 (the corresponding U.S. Pat. No. 5,324,613). For this toner, triboelectric property differs between low and high values of humidity, and the toner is thus largely affected by environmental conditions. A toner containing a compound having an Al complex structure is proposed in Japanese Patent Application Laid-Open No. 63-208865 (the corresponding U.S. Pat. No. 4,845,003). In this toner, the development property after continuous copying in a low humidity is different from the initial one, thus resulting in large fluctuations caused by continuous use for multiple runs of copying.

There is therefore a demand for a toner, particularly a color toner, excellent in environmental stability and multiple-copy durability.

SUMMARY OF THE INVENTION

The present invention has an object to provide a toner, particularly a color toner, for developing an electrostatic charged image, which solves the problems as described above.

More specifically, the object of the present invention is to provide a toner, particularly a color toner, for developing an electrostatic charged image, which is little susceptible to transfer scattering in a high humidity as well as in a low humidity.

Another object of the present invention is to provide a toner, particularly a color toner, for developing an electrostatic charged image, which gives a high image concentration or density while inhibiting fogging to a low level.

More particularly, the object of the present invention is to provide a toner for developing an electrostatic image, comprising toner particles containing a binder resin, a coloring agent and a mixture of the following compounds (I) and (II), wherein the mixing ratio in weight of the compounds (I) to (II) is within a range of from 99:1 to 30:70

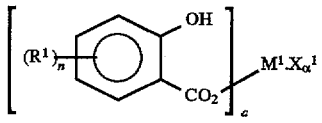

(I)

wherein, $R^1$ is alkyl group, halogen group or nitro group; n is an integer within a range of from 1 to 4; a is 1 or larger integer; $M^1$ is a divalent or higher metal atom; $X^1$ is an anion or a cation; and α is 0 or larger integer,

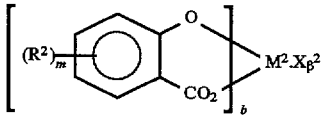

(II)

wherein, $R^2$ is alkyl group, halogen group or nitro group; m is an integer within a range of from 1 to 4; b is 1 or larger integer; $M^2$ is a divalent or higher metal atom; $X^2$ is an anion or a cation; and β is 0 or larger integer.

DETAILED DESCRIPTION OF THE PREFERRED EMBODIMENTS

The present inventors carried out extensive studies, and found as a result that a toner for developing an electrostatic charged image could be thermally stable with time and displayed excellent properties in various environments by adding a specific metal salt compound and a metal complex compound at a specific ratio. They thus developed the present invention.

In general, a toner using a metal complex of aromatic oxycarboxylic acid as a charge controlling agent shows a decrease in the charging rate in a low humidity, although it may exhibit a relatively high amount of charge.

This is considered attributable to adsorption and release of moisture near metal atoms, and particularly to the fact that the decreased amount of adsorbed water in the metal complex in the low humidity results in a higher resistance and hence in a decreased charging rate.

A toner using a metal salt of aromatic hydroxycarboxylic acid as a charge controlling agent generally tends to be largely affected by adsorbed water in the presence of polar group particularly in a high humidity, resulting in a decreased amount of charge in a high humidity, which exerts an adverse effect on image formation.

According to studies carried out by the present inventors, it is now possible to minimize fogging while maintaining a high amount of charge in a low humidity as well as in a high humidity by adding a metal complex and a metal salt of aromatic oxy- or hydroxycarboxylic acid to a toner.

They furthermore found availability of a toner giving considerably inhibited transfer scattering of toner and a high-gradation image in electrostatic transfer of toner from an electrostatic charge holding member such as a photosensitive member in various environments including a low humidity and a high humidity.

A conceivable reason is that a satisfactory balance is maintained between the charging rate and the amount of charge, thus leading to a sharp charge distribution of the toner, making it possible to achieve a uniform transfer.

The mixing ratio in weight of the compounds (I) to (II) [(I)/(II)] should preferably be within a range of from 99/1 to 30/70.

When the ratio (I)/(II)>99/1, the toner is affected by adsorbed water in a high humidity, causing a decrease in the amount of charge. If the ratio (I)/(II)<30/70, on the other hand, the charging rate is reduced in a low humidity according as resistance becomes higher, and fogging tends to easily occur. The ratio (I)/(II) should more preferably be within a range of from 98/2 to 35/65, or further more preferably, within a range of from 95/5 to 40/60.

$R^1$ and $R^2$ should preferably be alkyl group having a carbon number of from 1 to 10, chlorine, iodine or nitro group, or more preferably, n-alkyl group, sec-alkyl group or tert-alkyl group having a carbon number of from 4 to 8. $M^1$ and $M^2$ should preferably be a divalent or trivalent metal ion, or more preferably, zinc or aluminum.

Among others, a should preferably be within a range of from 1 to 3, and b should preferably be 2.

Preferable $M^1$ and $M^2$ include sulfate ion, nitrate ion, halogen ion, hydroxy ion, proton and alkaline metal ion.

Further, $\alpha$ and $\beta$ should preferably be an integer within a range of from 0 to 2.

Use of the mixture Of compounds (I) and (II) in an amount of from 0.1 to 15 parts by weight, or preferably from 1 to 10 parts by weight, per 100 parts by weight of binder resin is desirable for stabilizing triboelectric property and electrophotographic properties in various environments of the toner.

The foregoing mixture of compounds (I) and (II), being white, colorless of bright in color, is satisfactory as a controlling agent of a negative charge characteristics of a negative charged color toner.

Preferable aromatic hydroxycarboxylic acid or derivatives thereof serving as an ion in pair with a metal having a ligand and salt structure of the metal compounds used in the present invention include the following compounds:

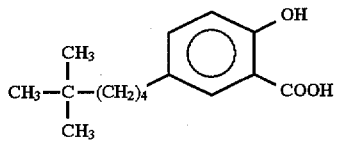

(1)

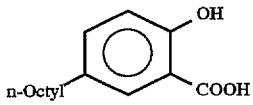

(2)

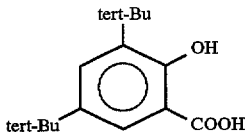

(3)

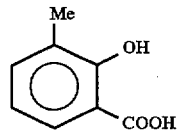

(4)

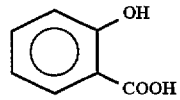

(5)

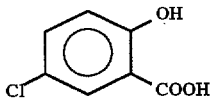

(6)

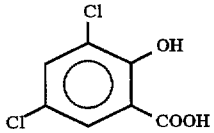

(7)

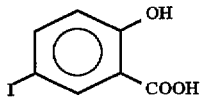

(8)

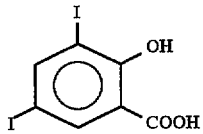

(9)

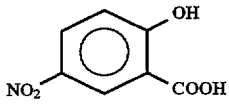

(10)

Example of manufacture of metal salt (I) of aromatic carboxylic acid

First 5-(5-t-octyl) salicylic acid was heated and dissolved in an aqueous NaOH solution, then an $Al_2(SO_4)_3$ solution was dripped into the resultant solution and heated and reacted under from neutral to alkaline conditions. Sampling through filtration, water rinsing and drying were conducted sufficiently and 5-(5-t-octyl) aluminum salicylate salt was obtained.

$^1$H-NMR analysis of 5-(5-t-octyl) salicylic acid itself demonstrated that hydroxy group had a hydrogen bond within molecule. There was therefore a unique peak near δ=12.1. A similar measurement of the foregoing reaction product revealed that it had a peak near δ=11.1: presence of hydroxy group not having a hydrogen bond in molecule was confirmed. It was confirmed from presence of a carbonyl group and a benzene ring as detected by an IR analysis that this was a derivative of 3,5-di-t-butyl salicylic acid, and from an XMA, presence of Al. It was also confirmed that this reaction product was an aluminum salt of aromatic hydroxycarboxylic acid as expressed by the following formula:

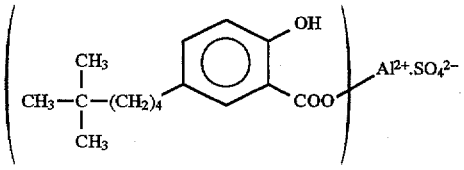

Similarly, by using $ZnCl_2$ in place of $Al_2(SO_4)_3$, a zinc salt of aromatic hydrocarboxylic acid was produced.

Example of manufacture of metal complex of aromatic oxycarboxylic acid 5-(5-t-octyl) salicylic acid was heated and dissolved in a THF/water mixed solvent. $Al_2(SO_4)_3$ was dissolved in the THF/water mixed solution; and 5-(5-t-octyl) salicylic acid was dripped while stirring. The resultant solution was heated and reacted under from neutral to acidic conditions, and sampling through filtration, water rinsing and drying were sufficiently carried out, thus obtaining 5-(5-t-octyl) aluminum salicylate complex.

As in the foregoing example of manufacture of the metal salt of aromatic hydroxycarboxylic acid, an analysis was carried out by $^1$H-NMR and revealed that a peak intrinsic to a ligang alone or a peak of hydroxy group resulting from the salt structure was non-existent.

An IR analysis of the reaction product permitted confirmation, from presence of carbonyl group and benzene ring, that the product was a derivative of 5-(5-t-octyl) salicylic acid, and an XMA demonstrated presence of Al, and that this reaction product was an aluminum complex of aromatic oxycarboxylic acid as expressed by the following formula:

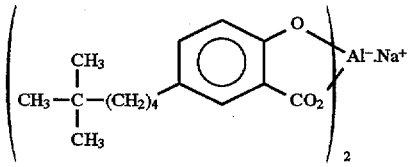

Similarly, by using $ZnCl_2$ in place of $Al_2(SO_4)_3$, a zinc complex of aromatic oxycarboxylic acid was produced.

The ratio of the metal salt (I) to the metal complex (II) of the salicylic acid derivative is adjusted to a prescribed value by mixing the metal salt and the metal complex. By changing the solvent, seed, ratio, pH or reaction temperature in a stage of synthesis, the ratio of metal salt to metal complex may be adjusted in a stage of synthesis. The ratio can be determined by knowing the total amount of metal salt and metal complex of aromatic oxy- or hydroxysalicylic acid through measurement of the quantity of Al from an XPS analysis. Further, the ratio of metal salt to metal complex can be determined from the area of the peak near δ=11.1 ppm by using $^1$H-NMR and the area near δ=7–8 ppm resulting from aromatic group.

Binder resins applicable in the toner of the present invention include: polystyrene; comonomers of styrene substituent such as poly-p-chlorostyrene and polyvinyl toluene; styrene based copolymers such as styrene-p-chlorostyrene copolymer, styrene-vinyl toluene copolymer, styrene-vinyl naphthalene copolymer, styrene-acrylic acid ester copolymer, styrene-methacrylic acid ester copolymer, styrene-α-chloromethacrylic acid methyl copolymer, styrene acrylonitrile copolymer, styrene-vinylmethylether copolymer, styrene-vinylethylether copolymer, styrene-vinylmethylketone copolymer, styrene-butadiene copolymer, styrene-isoprene copolymer, and styrene-acrylonitrile-indene copolymer; polyvinyl chloride, phenol resin, natural modified phenol resin, natural resin modified maleic acid resin, acryl resin, methacryl resin, polyvinyl acetate, silicone resin, polyester resin, polyurethane, polyamide resin, furan resin, epoxy resin, xylene resin, polyvinyl butyral, terpene resin, coumarone-indene resin, and petroleum based resins.

A cross-linked styrene based copolymers are also preferable binder resins.

Concrete examples of comonomer relative to styrene based copolymer styrene monomer include: monocarboxylic acids having a double bond and substituents thereof such as acrylic acid, methyl acrylate, ethyl acrylate, butyl acrylate, dodecyl acrylate, octyl acrylate, 2-ethylhexyl-acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and substituents thereof such as maleic acid, butyl maleate, methyl maleate, and dimethyl maleate; vinyl esters such as vinyl acetate and vinyl benzoate; ethylene based olefins such as ethylene, propylene and butylene; vinylketones such as vinylmethylketone, and vinylhexylketone; and vinyl ethers such as vinylmethylether, vinylethylether and vinylisobutyl ether. These comonomers are used singly or in combination of two or more.

As a cross-linking agent of vinyl resins, a compound having a double bond capable of giving polymerization of two or more is mainly used. Examples include: aromatic divinyl compounds such as divinyl benzene and divinyl naphthalene; esters carboxylate having two double bonds such as ethyleneglycol diacrylate, ethyleneglycol dimethacrylate, and 1,3-butanediol dimethacrylate; divinyl compounds such as divinyl aniline, divinylether, divinylsulfide and divinylsulfon; and compounds having three or more vinyl groups. These cross-linking agents are used singly or in mixture.

A styrene-acryl based binder resin or styrene-methacryl based binder resin should preferably have at least one peak in the molecular weight region of from 3,000 to 50,000 as observed in the molecular weight distribution based on gel permeation chromatography (GPC) of tetrahydrofuran (THF) soluble fraction, at least one peak in the molecular weight region of 100,000 or more, and contain components having a molecular weight of up to 100,000 accounting for 50 to 90%.

A polyester based binder resin should preferably have at least one peak in the molecular weight region of from 3,000 to 50,000 as observed in the molecular weight distribution, and contain components having a molecular weight of up to 100,000 accounting for 60 to 100%, or more preferably, have at least one peak in the molecular weight region of from 5,000 to 20,000.

Polyester resin is excellent in fixability and is therefore suitable for a color toner. Particularly a polyester resin formed by condensation-copolymerization of a diol component and a carboxylic acid component comprising a divalent or higher carboxylic acid or an acid anhydride thereof or a lower alkylester thereof (for example, fumaric acio, maleic acid, maleic anhydride, phthalic acid, terephthalic acid, trimellitic acid, pyromellitic acid, etc.), with bisphenol derivative expressed in the following formula (III) as the main component of the diol component, is preferable because of its satisfactory fixability, color mixing property and charge characteristics.

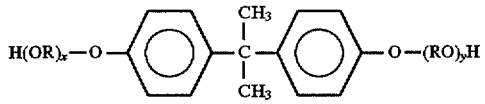

(III)

wherein, R is ethylene or propylene group; X and Y is 1 or larger integer; and the average value of X+Y is within a range of from 2 to 10.

The toner of the present invention may be used as a magnetic toner by adding a magnetic fine powder. The average particle size of the magnetic fine powder should preferably be within a range of from 0.05 to 0.5 μm, or more preferably, from 0.1 to 0.4 μm. The coefficient of variation of the particle size of the magnetic fine powder should preferably be up to 30%. The quantity of magnetic fine powder to be added to the magnetic toner should preferably be within a range of from 40 to 120 parts by weight relative to 100 parts by weight of resin component.

Applicable magnetic materials include: iron oxides such as magnetite, γ-iron oxide, ferrite and iron excess type ferrite; metals such as Fe, Co and Ni, alloys of these metals with such other metals as Al, Co, Cu, Pb, Mg, Sn, Zn, Sb, Be, Bi, Cd, Ca, Mn, Se, Ti, W and V and mixtures thereof.

The toner of the present invention may contain a wax component.

Applicable wax components include: an alkylene polymer formed by radically polymerizing alkylene under a high pressure; an alkylene polymer formed by polymerization with the use of a Ziegler catalyst under a low pressure; an alkylene polymer available by pyrolyzing an alkylene polymer of a high molecular weight; and a polymethylene available through hydrogenation of the distillation residue of a hydrocarbon obtained by the Arge method from a synthetic gas comprising carbon monoxide and hydrogen. Among these hydrocarbon wax materials, the hydrocarbon wax prepared through extraction of specific components and separation thereof is particularly suitable. Ones of which a low molecular weight fraction is removed, of which a low molecular weight fraction is extracted, and of which a low molecular weight fraction is further removed therefrom by press sweating, solvent fractionation, or a fractionation recrystallization system utilizing vacuum distillation are preferable.

In addition, microcrystalline wax, carnauba wax, sazole wax and paraffin wax are also applicable.

These wax materials should preferably have a number-average molecular Weight (as converted into polyethylene) within a range of from 500 to 1,200, and a weight average molecular weight within a range of from 800 to 3,600.

The effective quantity of the wax is within a range of from 0.5 to 10 parts by weight relative to 100 parts by weight of binder resin.

Coloring agents applicable for the toner of the present invention include conventionally known coloring agents and from black to white pigments. Among others, colored organic pigments having a high lipophilicity are particularly preferable.

Such pigments include, for example: Naphthol Yellow-S, Hansa Yellow-G, Permanent Yellow-NCG, Permanent Orange GTR, Pyrzolone Orange, Benzidine Orange G, Permanent Red 4R; Watching Red Calcium Salt, Brilliant Carmine 3B, Fast Violet B, Methyl Violet Lake, Phthalocyanine Blue, Fast Sky Blue, and Indanthrene Blue BC.

Preferable ones are high light resistance pigments such as poly-condensate azo-based pigments, non-soluble azo-based pigments, quinacridone-based pigments, isoindolinone-based pigments, perylene-based pigments, anthraquinone-based pigments, and copper phthalocyanine-based pigments.

Particularly preferable magenta organic pigments include: C.I. Pigments Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 202, 206, 207, 209, and 238, C.I. Pigments Violet 19, C.I. Vat Red 1, 2, 10, 13, 15, 23, 29 and 35.

Applicable cyan organic pigments include: C.I. Pigments Blue 2, 3, 15, 16 and 17, C.I. Vat Blue 6, C.I. Acid Blue 45 and copper phthalocyanine pigments prepared by substituting 1 to 5 phthalimidomethyl groups in a phthalocyanine skeleton having a structure as expressed by the following formula:

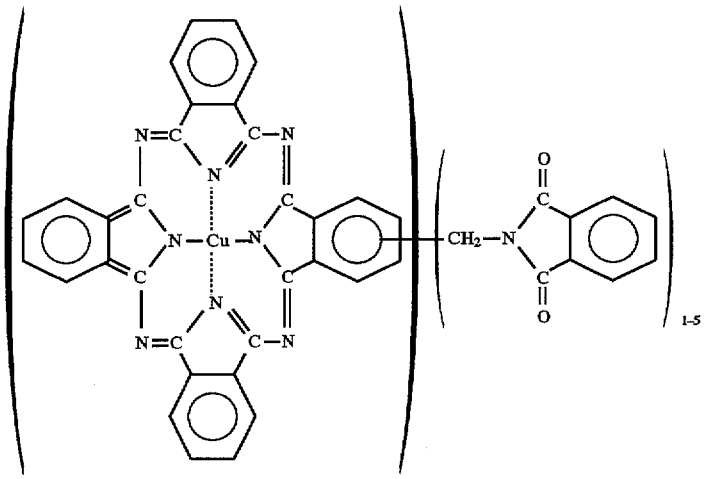

1-5

Applicable yellow organic pigments include: C.I. Pigments Yellow 1, 2, 3, 4, 5, 6, 7, 10, 11, 12, 13, 14, 15, 16, 17, 23, 65, 73, 74, 81, 83, 93, 94, 95, 97, 98, 109, 120, 128, 138, 147, 151, 154, 166, 167, 173, 180 and 181, and C.I. Vat Yellow 1, 3 and 20.

It is desirable to use a pasty organic pigment obtained from organic pigment slurry before the filtration step during the manufacturing process without undergoing the drying step. An organic powder pigment once dried and then made pasty by using an aqueous medium is not preferable.

The quantity of coloring agent, in the case of a yellow toner sensitively reacting to OHP film transmissivity, should be within a range of from 0.1 to 12 parts by weight relative to 100 parts by weight of binder resin, or more preferably, from 0.5 to 7 parts by weight.

With a quantity of over 12 parts by weight, the coloring agent is poor in reproducibility of green and red which are mixed colors of yellow, and in the case of a full-color image, poor in reproducibility of human skin color.

The quantity of a Magenta coloring agent or a cyan coloring agent should predictably be within a range of from 0.1 to 15 parts by weight, or more preferably, from 0.1 to 9 parts by weight relative to 100 parts by weight of binder resin.

The toner of the present invention may be used in mixture with a fluidity imparting agent.

The agent applicable as a fluidity improving agent is one which improves fluidity by adding to the toner as compared with that before addition. Applicable ones include: a hydrophobic colloidal silica fine powder, a colloidal silica fine powder, a hydrophobic titanium oxide fine powder, a titanium oxide fine powder, hydrophobic alumina fine powder, an alumina fine powder and mixed powder thereof.

The toner of the present invention can be formed by a method of sufficiently kneading component materials such as a binder resin, a coloring agent, and compounds (I) and (II) in a thermal kneading apparatus such as a thermal roll, a kneader or an extruder, and then mechanically milling and classifying the kneaded product; a method of dispersing materials such as a coloring agent and compounds (I) and (II) in a solution of a binder resin, and then spraying and drying the resultant solution; or a polymerized toner manufacturing method of polymerizing a monomer composition prepared by mixing prescribed materials such as a coloring agent and compounds (I) and (II) with a monomer for forming a binder resin in an aqueous medium, thereby obtaining toner particles.

The toner of the present invention can be used as a one-component developing agent, and can be used also as a two-component developing agent by mixing with a carrier. It is recommendable to appropriately adjust resistance value of the carrier used through adjustment of the extent of surface irregularities of carrier particles and the amount of resin for covering.

When covering the surface of carrier particles, applicable resins include: styrene-ester acrylate copolymer, styrene-ester methacrylate copolymer, ester acrylate copolymer, ester methacrylate copolymer, modified or non-modified silicone resin, fluorine-containing resin, polyamide resin, ionomer resin, and polyphenylene sulfide resin. These resins may be used in mixture.

Applicable magnetic materials for carrier core include: magnetic oxides such as ferrite, iron excess type ferrite, magnetite and γ-iron oxide.

A satisfactory result is available by using a mixing ratio of the toner to the carrier so that the toner concentration in the developing agent is within range of from 1 to 15 wt. %, or preferably, from 2 to 13 wt %.

Now, the present invention will be described in detail below by means of examples. It is needless to mention that the present invention is not limited in any manner by the following examples.

EXAMPLE 1

Polyester resin formed from ethoxy-modified and propoxy-modified bisphenol A/fumaric acid/trimellitic acid: 100 parts by weight (weight average molecular weight: 12,000; Mw/Mn: 3.5; main peak is existent at molecular weight of 10,000.)

Copper phthalocyanine pigment (C.I. Pigment Blue 15): 4 parts by weight 5-(5-t-octyl) aluminum salicylate salt [compound (I)]: 2 parts by weight 5-(5-t-octyl) aluminum salicylate complex [compound (II)]: 2 parts by weight The foregoing materials were sufficiently blended in a blender, and the mixed and kneaded in a biaxial kneader/extruder set at 150° C. The resultant kneaded product was cooled and roughly crushed in a cutter mill. Then, the product was finely milled or pulverized on a pulverizer using air jet, and the resultant fine powder was classified by a fixed wall type blowing classifier to obtain a primary classified powder.

From the resultant primary classified powder, extra-fine and coarse fractions were strictly classified and removed in a multi-division classifier (elbow-jet classifier made by Nittetsu Kogyo Company) utilizing Coanda effect to obtain a negative triboelectric non-magnetic cyan toner having a particle size of 6.5 μm.

Cyan toner No. 1 was obtained by mixing 100 parts by weight of cyan toner thus obtained and 2 parts by weight of titanium oxide ($TiO_2$) fine particles subjected to hydrophobicity treatment.

EXAMPLES 2 to 6 and COMPARATIVE EXAMPLES 1 to 4

Negative triboelectric non-magnetic cyan toners Nos. 2 to 6 and comparative cyan toners Nos. 1 to 4 were prepared in the same manner as in Example 1, except that compounds (I) and (II) were used in the mixing ratio shown in Table 1.

TABLE 1

| | | Metal salt (I)/metal complex (II) | Weight parts | Mixing ratio in weight |
|---|---|---|---|---|
| Example 1 | Cyanic toner No. 1 | 5-(5-t-octyl) aluminum salicylate salt/5-(5-t-octyl) aluminum salicylate complex | 4 | 50/50 |
| Example 2 | Cyanic toner No. 2 | 5-(5-t-octyl) aluminum salicylate salt/5-(5-t-octyl) aluminum salicylate complex | 4 | 30/70 |
| Comparative Example 1 | Comparative cyanic toner No. 1 | 5-(5-t-octyl) aluminum salicylate salt/5-(5-t-octyl) aluminum salicylate complex | 4 | 95/5 |
| Comparative Example 2 | Comparative cyanic | 5-(5-t-octyl) aluminum salicylate salt/5-(5- | 4 | 100/0 |

TABLE 1-continued

| | | Metal salt (I)/metal complex (II) | Weight parts | Mixing ratio in weight |
|---|---|---|---|---|
| | toner No. 2 | t-octyl) aluminum salicylate complex | | |
| Example 4 | Cyanic toner No. 4 | 5-(5-t-octyl) zinc salicylate salt/5-(5-t-octyl) zinc salicylate complex | 4 | 50/50 |
| Example 5 | Cyanic toner No. 5 | 5-(5-t-octyl) zinc salicylate salt/5-(5-t-octyl) zinc salicylate complex | 4 | 30/70 |
| Example 6 | Cyanic toner No. 6 | 5-(5-t-octyl) zinc salicylate salt/5-(5-t-octyl) zinc salicylate complex | 4 | 95/5 |
| Comparative Example 3 | Comparative cyanic toner No. 3 | 5-(5-t-octyl) zinc salicylate salt/5-(5-t-octyl) zinc salicylate complex | 4 | 100/0 |
| Comparative Example 4 | Comparative cyanic toner No. 4 | 5-(5-t-octyl) zinc salicylate salt/5-(5-t-octyl) zinc salicylate complex | 4 | 20/80 |

Image forming test

A two-component developing agent was prepared by mixing 94 parts by weight of fluorine-acryl coated ferrite carrier having an average particle size of 50 μm and 6 parts by weight of each of the cyan toners. Each cyan toner had negative frictional change as a result of mixture with the coated carrier.

Each two-component developing agent was introduced into a full-color laser copying machine (CLC-700 made by Cannon Inc.) and was subjected for evaluation to a copying test of 10,000 sheets in monochromatic mode using an original manuscript of an image area ratio of 25% under environmental conditions including a temperature of 30° C., and a humidity of 80% RH, or a temperature of 20° C. and a humidity of 20% RH. The result is shown in Table 2.

In the case of cyan toners Nos. 1 to 3 of Examples 1 to 3, both the initial image and the image after continuous copying of 10,000 sheets were free from fogging in any of the two sets of environment, with a sufficient image concentration or density, and were almost free from transfer scattering with an excellent gradation.

In the case of the comparative cyan toner No. 1 of Comparative Example 1, serious fogging occurred and scattering was observed at a temperature of 30° C. and a humidity of 80% RH after copying 10,000 sheets. This is considered attributable to the fact that, because of the salt structure, there was a residual polar group, and the copy was largely affected by absorbed water, resulting in a decreased amount of charge of the toner.

In the case of the comparative cyan toner No. 2 of Comparative Example 2, marked fogging occurred and scattering was confirmed at a temperature of 20° C. and a humidity of 20% RH after copying for 10,000 runs. This is considered to be due to the fact that the complex-rich composition led to a decrease in adsorbed water in the low-humidity environment and hence to a higher resistance, thus resulting in fogging and scattering corresponding to a low evaluation.

In the case of the cyan toner No. 4 of Example 4, there was almost no scattering, and a good results was obtained.

In the case of the cyan toner No. 5 of Example 5, comprehensively good result was obtained, although fogging was observed after copying 10,000 sheets.

In the case of the cyan toner No. 6 of Example 6, a satisfactory result was obtained, although slight In the case of the comparative cyan toner No. 3 of Comparative Example 3, there were considerable fluctuations of image concentration or density and scattering was on a rather bad level at a temperature of 30° C. and a humidity of 80% RH after copying 10,000 sheets. The effect of polar group is considered to have been apparent.

In the case of the comparative cyan toner No. 4 of Comparative Example 4, both scattering and fogging were serious and fluctuation of concentration was considerable at a temperature of 20° C. and a humidity of 20% RH after copying 10,000 sheets. This is attributable to the fact that the complex-rich composition led to a decreased charging rate, as in Comparative Example 2.

TABLE 2

| | Initial | | | | | | After 10,000 copies | | | | | |
|---|---|---|---|---|---|---|---|---|---|---|---|---|
| | 30° C./80% r.h. | | | 20° C./20% r.h. | | | 30° C./80% r.h. | | | 20° C./20% r.h. | | |
| | Scatter | Concentration | Fog | Scatter | Concentration | Fog | Scatter | Concentration | Fog | Scatter | Concentration | Fog |
| Example 1 | A | 1.75 | 0.1 | A | 1.74 | 0.1 | A | 1.76 | 0.2 | A | 1.74 | 0.2 |
| Example 2 | A | 1.75 | 0.1 | A | 1.75 | 0.2 | A | 1.74 | 0.2 | B | 1.77 | 0.4 |
| Example 3 | A | 1.76 | 0.2 | A | 1.74 | 0.1 | B | 1.78 | 0.4 | A | 1.75 | 0.2 |
| Comparative Example 1 | B | 1.77 | 0.4 | B | 1.73 | 0.2 | C | 1.84 | 1.0 | C | 1.75 | 0.4 |
| Comparative Example 2 | A | 1.75 | 0.2 | B | 1.77 | 0.4 | B | 1.74 | 0.3 | C | 1.82 | 0.9 |
| Example 4 | A | 1.77 | 0.1 | A | 1.76 | 0.2 | B | 1.78 | 0.4 | B | 1.77 | 0.2 |
| Example 5 | A | 1.77 | 0.2 | B | 1.78 | 0.3 | B | 1.78 | 0.4 | B | 1.79 | 0.5 |
| Example 6 | B | 1.79 | 0.4 | B | 1.76 | 0.3 | B | 1.80 | 0.6 | B | 1.79 | 0.4 |
| Comparative Example 3 | C | 1.80 | 0.9 | B | 1.77 | 0.4 | D | 1.89 | 2.0 | C | 1.78 | 0.5 |
| Comparative Example 4 | B | 1.77 | 0.4 | B | 1.77 | 0.4 | B | 1.78 | 0.5 | D | 1.88 | 1.8 |

Symbols: A: excellent, B: good, C: fine, D: poor

The methods used for evaluation are described below.

Measurement of fogging.

Fogging was measured by the use of a Reflectometer Model TC-6DS made by Tokyo Denshoku Company. An amber filter was used for the cyan image, which was calculated by the following formula:

Fogging (reflectivity) (%)=[reflectivity of standard paper (%)]−[reflectivity of non-image portion of sample (%)]

A smaller value corresponds to a slighter occurrence of fogging.

Measurement of image concentration (or density)

An RD-918 reflection Concentration meter (SPI filter) made by Macbeth Company was employed for measuring the image concentration.

Measurement of scattering

A character image fixed on a transfer sheet of paper containing the copy by the use of a full-color laser copying machine was enlarged with a 50-magnifications lens, and the number of toner particles scattered around the character was visually measured. More than 50 characters were measured, and the average value per character was evaluated with reference to the following four stage of criteria:

A: Number of toner particles: 0 to 10 particles

B: Number of toner particles: 11 to 20 particles

C: Number of toner particles: 21 to 40 particles

D: Number of toner particles: 41 or more

What is claimed is:

1. A toner for developing an electrostatic image, comprising toner particles containing a mixture of a binder resin, a coloring agent and the following compounds (I) and (II), wherein the mixing ratio in weight of the compounds (I) to (II) is within a range of from 99:1 to 30:70

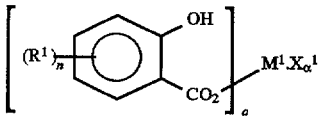

(I)

wherein, $R^1$ is alkyl group; halogen group or nitro group; n is an integer within a range of from 1 to 4; a is 1 or larger integer; $M^1$ is a divalent or higher metal: $X^1$ is an anion or a cation; and α is 0 or larger integer

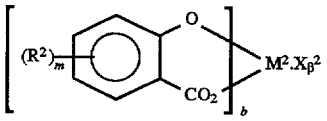

(II)

wherein, $R^2$ is alkyl group, halogen group or nitro group; m is an integer within a range of from 1 to 4; b is 1 or larger integer; $M^2$ is a divalent or higher metal; $X^2$ is an anion or cation; and β is 0 or larger integer.

2. The toner according to claim 1, wherein said toner particles are toner particles with negative triboelectric property.

3. The toner according to claim 1, wherein said toner particles are non-magnetic color toner particles with negative triboelectric property and chromatic color.

4. The toner according to claim 3, wherein said toner particles are non-magnetic color toner particles with negative triboelectric property and chromic color selected from the group consisting of cyan toner particles with negative triboelectric property, magenta toner particles with negative triboelectric property, and yellow toner particles with negative triboelectric property.

5. The toner according to claim 1, wherein said $M^1$ and $M^2$ represent a trivalent metal.

6. The toner according to claim 5, wherein said $M^1$ and $M^2$ represent aluminum.

7. The toner according to claim 1, wherein said $M^1$ and $M^2$ represent a divalent metal.

8. The toner according to claim 7, wherein said $M^1$ and $M^2$ represent zinc.

9. The toner according to claim 1, wherein said compounds (I) and (II) are present in a ratio within a range of from 98:2 to 35:65.

10. The toner according to claim 1, wherein said compounds (I) and (II) are present in a ratio within a range of from 95:5 to 40:60.

11. The toner according to claim 1, wherein for said compounds (I) and (II), $R^1$ and $R^2$ represent alkyl group having a carbon number of from 1 to 10, chlorine, iodine or nitro group; $M^1$ and $M^2$ represent divalent or trivalent metal ion; a represents an integer of from 1 to 3; said $M^1$ and $M^2$ represent sulfate ion, nitrate ion, halogen ion, hydroxy ion, proton or alkali metal ion; and α and β represent an integer of from 1 to 2.

12. The toner according to claim 11, wherein said $R^1$ and $R^2$ represent n-alkyl group, sec-alkyl group or a tert-alkyl group.

13. The toner according to claim 1, wherein said mixture of the compounds (I) and (II) is contained in an amount within a range of from 0.1 to 15 parts by weight relative to 1000 parts by weight of binder resin.

14. The toner according to claim 1, wherein said mixture of the compounds (I) and (II) is contained in an amount within a range of from 1 to 10 parts by weight relative to 100 parts by weight of binder resin.

15. The toner according to claim 1, wherein said binder resin is a styrene-acryl copolymer or a styrene-methacryl copolymer.

16. The toner according to claim 1, wherein said binder resin is a polyester resin.

* * * * *

UNITED STATES PATENT AND TRADEMARK OFFICE

CERTIFICATE OF CORRECTION

PATENT NO. : 5,665,513

DATED : September 9, 1997

INVENTOR(S): TETSUYA IDA ET AL.

It is certified that error appears in the above-identified patent and that said Letters Patent is hereby corrected as shown below:

ON TITLE PAGE, AT [56], REFERENCES CITED, FOREIGN PATENT DOCUMENTS

"42-24748 10/1968 Japan." should read
--43-24748 10/1968 Japan.--

ON TITLE PAGE, AT [57], ABSTRACT

Line 4, "agend" should read --agent--.

COLUMN 1

Line 18, "former" should read --former is--;
Line 46, "is" should read --are--.

COLUMN 3

Line 14, "polar" should read --a polar--;
Line 41, "ing" should read --ingly--;
Line 53, "Preferable" should read --Preferably--;
Line 58, "OF" should read --of--;
Line 65, "of" should read --or--.

COLUMN 5

Line 4, "presence" should read --the presence--;
Line 23, "solution;" should read --solution,--;
Line 32, "ligang" should read --ligand--.

UNITED STATES PATENT AND TRADEMARK OFFICE

CERTIFICATE OF CORRECTION

PATENT NO. : 5,665,513

DATED : September 9, 1997

INVENTOR(S): TETSUYA IDA ET AL.

It is certified that error appears in the above-identified patent and that said Letters Patent is hereby corrected as shown below:

COLUMN 6

Line 16, "A cross-linked" should read --Cross-linked--;
Line 67, "acio," should read --acid--.

COLUMN 7

Line 6, "characteristics." should read --characteristics:--.

COLUMN 8

Line 7, "Weight" should read --weight--.

COLUMN 10

Line 31, "the" should read --then--;

Table 1,

Example 1, "95/5" should read --100/0--; and
Example 2, 100/0 should read --20/80--; and insert:

| | | | | |
|---|---|---|---|---|
| --Example 3 | Cyanic toner No. 3 | 5-(5-t-octyl) aluminum salicylate salt/5-(5-t-octyl) aluminum salicylate complex | 4 | 95/5 --. |

UNITED STATES PATENT AND TRADEMARK OFFICE

CERTIFICATE OF CORRECTION

PATENT NO. : 5,665,513

DATED : September 9, 1997

INVENTOR(S): TETSUYA IDA ET AL.

It is certified that error appears in the above-identified patent and that said Letters Patent is hereby corrected as shown below:

COLUMN 12

Line 26, "results" should read --result;
Line 28, "result was" should read --results were--;
Line 31, "slight" should read --slight scattering was observed--;
Line 37, "of" should read --of a--.

COLUMN 13

Line 12, "Concentration" should read --concentration--;
Line 22, "stage" should read --stages--.
Line 40, "alkyl group;" should read --an alkyl group,--;
Line 42, "metal:" should read --metal;--;
Line 50, "alkyl" should read --an alkyl--.

UNITED STATES PATENT AND TRADEMARK OFFICE

CERTIFICATE OF CORRECTION

PATENT NO. : 5,665,513

DATED : September 9, 1997

INVENTOR(S): TETSUYA IDA ET AL.

It is certified that error appears in the above-identified patent and that said Letters Patent is hereby corrected as shown below:

COLUMN 14

Line 29, "alkyl" should read --an alkyl--;
Line 32, "divalent" should read --a divalent--;
Line 42, "1000" should read --100--.

Signed and Sealed this

Seventh Day of July, 1998

Bruce Lehman

*Attest:*

BRUCE LEHMAN

*Attesting Officer*

*Commissioner of Patents and Trademarks*